US009381614B2

(12) United States Patent
Takahashi et al.

(10) Patent No.: US 9,381,614 B2
(45) Date of Patent: Jul. 5, 2016

(54) PRESSURE REGULATOR, POLISHING APPARATUS HAVING THE PRESSURE REGULATOR, AND POLISHING METHOD

(71) Applicant: EBARA CORPORATION, Tokyo (JP)

(72) Inventors: Nobuyuki Takahashi, Tokyo (JP); Toru Maruyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 372 days.

(21) Appl. No.: 13/948,238

(22) Filed: Jul. 23, 2013

(65) Prior Publication Data

US 2014/0087629 A1 Mar. 27, 2014

(30) Foreign Application Priority Data

Jul. 23, 2012 (JP) ..... 2012-162248

(51) Int. Cl.

| | |
|---|---|
| ***B24B 49/00*** | (2012.01) |
| ***B24B 37/34*** | (2012.01) |
| ***B24B 37/005*** | (2012.01) |
| ***B24B 7/22*** | (2006.01) |

(52) U.S. Cl.

CPC ..... *B24B 37/345* (2013.01); *B24B 7/228* (2013.01); *B24B 37/005* (2013.01); *Y10T 137/7761* (2015.04)

(58) Field of Classification Search

USPC ..... 451/5, 6, 288, 296

See application file for complete search history.

(56) References Cited

U.S. PATENT DOCUMENTS

| | | | | |
|---|---|---|---|---|
| 6,129,613 | A * | 10/2000 | Bothra | B24B 37/30 257/417 |
| 6,926,585 | B2 * | 8/2005 | Togawa | B24B 49/16 451/288 |
| 7,207,871 | B1 * | 4/2007 | Zuniga | B24B 49/16 451/288 |
| 2006/0081288 | A1 * | 4/2006 | Jacobsen | F16K 31/0637 137/14 |

FOREIGN PATENT DOCUMENTS

| | | | |
|---|---|---|---|
| JP | 2001-105298 | A | 4/2001 |
| JP | 2005-081507 | A | 3/2005 |
| JP | 2007-507079 | A | 3/2007 |
| JP | 2010-050436 | A | 3/2010 |

OTHER PUBLICATIONS

WO 2005/005101 A1, which is the international publication of JP 2007-507079 A; dated Jan. 20, 2005.

* cited by examiner

*Primary Examiner* — Joseph J Hail
*Assistant Examiner* — Shantese McDonald
(74) *Attorney, Agent, or Firm* — Pearne & Gordon LLP

(57) ABSTRACT

A pressure regulator includes: a pressure-regulating valve configured to regulate pressure of a fluid supplied from a fluid supply source; a first pressure sensor configured to measure the pressure regulated by the pressure-regulating valve; a second pressure sensor located downstream of the first pressure sensor; a PID controller configured to produce a correction pressure command value for eliminating a difference between a pressure command value and a pressure value of the fluid measured by the second pressure sensor; and a regulator controller configured to control operation of the pressure-regulating valve so as to eliminate a difference between the correction pressure command value and a pressure value of the fluid measured by the first pressure sensor.

11 Claims, 14 Drawing Sheets

PRESSURE REGULATOR, POLISHING APPARATUS HAVING THE PRESSURE REGULATOR, AND POLISHING METHOD

CROSS-REFERENCE TO RELATED APPLICATIONS

This application claims priority to Japanese Patent Application No. 2012-162248 filed Jul. 23, 2012, the entire contents of which are hereby incorporated by reference.

BACKGROUND OF THE INVENTION

1. Field of the Invention

The present invention relates to a pressure regulator for regulating pressure in a pressure chamber used for pressing a substrate, such as a wafer, against a polishing pad. The present invention further relates to a polishing apparatus having such a pressure regulator. The present invention further relates to a polishing method using the aforementioned polishing apparatus.

2. Description of the Related Art

FIG. 1 is a schematic view of a polishing apparatus for polishing a wafer. As shown in FIG. 1, the polishing apparatus has a polishing table 22 for supporting a polishing pad 23, and a top ring 30 for pressing a wafer W against the polishing pad 23. The polishing table 22 is coupled to a table motor 29, which is provided below the polishing table 22, through a table shaft 22*a*. This table motor 29 is configured to rotate the polishing table 22 in a direction indicated by arrow. The polishing pad 23 is attached to an upper surface of the polishing table 22, and an upper surface of the polishing pad 23 serves as a polishing surface 23*a* for polishing the wafer W. The top ring 30 is secured to a lower end of a top ring shaft 27. The top ring 30 is configured to hold the wafer W on its lower surface via vacuum suction.

Polishing of the wafer W is performed as follows. The top ring 30 and the polishing table 22 are rotated in directions as indicated by arrows, while a polishing liquid (i.e., slurry) is supplied onto the polishing pad 23 from a polishing-liquid supply unit 25. In this state, the top ring 30, holding the wafer W on its lower surface, is lowered and presses the wafer W against the polishing surface 23*a* of the polishing pad 23. A surface of the wafer W is polished by a mechanical action of abrasive grains contained in the polishing liquid and a chemical action of the polishing liquid. Such polishing apparatus is known as CMP (chemical mechanical polishing) apparatus.

The top ring 30 has its lower portion constituted by a pressure chamber (not shown in FIG. 1) which is formed by a flexible membrane. A pressurized gas is supplied into the pressure chamber so that polishing pressure on the wafer W against the polishing pad 23 is regulated by the pressure in the pressure chamber. FIG. 2 is a schematic view showing a pressure regulator 100 for regulating the pressure in the pressure chamber by supplying a gas (e.g., air or nitrogen gas) into the pressure chamber of the top ring 30. As shown in FIG. 2, the pressure regulator 100 has a pressure-regulating valve 101 for regulating the pressure of the gas supplied from a gas supply source, a pressure sensor 102 for measuring the pressure (i.e., the secondary pressure) of the gas downstream of the pressure-regulating valve 101, and a regulator controller 103 for controlling operation of the pressure-regulating valve 101 based on a pressure value obtained by the pressure sensor 102. The pressure regulator 100 having such structures is known as an electropneumatic regulator.

The pressure-regulating valve 101 has a pilot valve 110 for regulating the pressure of the gas supplied from the gas supply source, and a gas-intake electromagnetic valve 111 and a gas-release electromagnetic valve 112 each for regulating pressure of a pilot air to be supplied to the pilot valve 110. The pilot valve 110 has a pilot chamber 115 and a valve element 116 coupled to the pilot chamber 115. A part of the pilot chamber 115 is formed from a diaphragm. The pilot air is supplied into the pilot chamber 115 through the gas-intake electromagnetic valve 111 and is discharged from the pilot chamber 115 through the gas-release electromagnetic valve 112. Therefore, the pressure in the pilot chamber 115 is controlled by operating the gas-intake electromagnetic valve 111 and the gas-release electromagnetic valve 112. The regulator controller 103 controls open-close operations of the electromagnetic valves 111, 112, and the valve element 116 is moved according to the pressure in the pilot chamber 115. Depending on the position of the valve element 116, the gas from the gas supply source passes through the pilot valve 110 or the gas downstream of the pilot valve 110 (i.e., the gas on the secondary side) is discharged through the pilot valve 110, so that the pressure of the gas existing downstream of the pilot valve 110 (i.e., the secondary pressure) is regulated.

The regulator controller 103 is coupled to a polishing controller 50 of the polishing apparatus, and is configured to receive a pressure command value which is sent from the polishing controller 50. The regulator controller 103 controls the operations of the gas-intake electromagnetic valve 111 and the gas-release electromagnetic valve 112 so as to eliminate a difference between a pressure current value of the gas measured by the pressure sensor 102 and the pressure command value to thereby adjust the pressure in the pressure chamber of the top ring 30.

However, when the pressure sensor 102 is affected by disturbance (e.g., temperature change), an output value of the pressure sensor 102 may deviate from an actual pressure. Such a deviation of the output value is called a temperature drift. Other than the temperature drift, a sliding resistance of the pilot valve 110, a measuring accuracy of the pressure sensor 102 itself, and a distance between the pressure regulator (i.e., electropneumatic regulator) 100 and a point of use may cause an error in the output value of the pressure sensor 102. Since the regulator controller 103 is operated such that the output value of the pressure sensor 102 is kept at the pressure command value, the actual gas pressure adjusted by the pressure regulator 101 may differ from the pressure command value. Moreover, if the polishing pressure on the wafer is controlled based on the pressure that differs from the actual pressure, an intended polishing result may not be obtained.

SUMMARY OF THE INVENTION

The present invention has been made in view of the above issue. It is therefore an object of the present invention to provide a pressure regulator capable of eliminating an error of a pressure measurement value that may be caused by a temperature drift of a pressure sensor and capable of regulating a fluid pressure with high accuracy. It is another object of the present invention to provide a polishing apparatus including such a pressure regulator. It is still another object of the present invention to provide a polishing method using such a polishing apparatus.

In order to achieve the above object, one aspect of the present invention provides a pressure regulator, comprising: a pressure-regulating valve configured to regulate pressure of a fluid supplied from a fluid supply source; a first pressure sensor configured to measure the pressure regulated by the pressure-regulating valve; a second pressure sensor located downstream of the first pressure sensor; a PID controller configured to produce a correction pressure command value for eliminating a difference between a pressure command value and a pressure value of the fluid measured by the second pressure sensor; and a regulator controller configured to control operation of the pressure-regulating valve so as to eliminate a difference between the correction pressure command value and a pressure value of the fluid measured by the first pressure sensor.

In a preferred aspect, the first pressure sensor and the pressure-regulating valve are assembled integrally and the second pressure sensor is separated from the first pressure sensor and the pressure-regulating valve.

In a preferred aspect, the second pressure sensor is located in an atmosphere with a constant temperature.

In a preferred aspect, the second pressure sensor is located in the atmosphere formed in a clean room with a constant temperature.

In a preferred aspect, the second pressure sensor has a higher pressure measuring accuracy than a pressure measuring accuracy of the first pressure sensor with respect to evaluation items including linearity, hysteresis, stability, and repeatability.

Another aspect of the present invention provides a polishing apparatus, comprising: a polishing table for supporting a polishing pad; a top ring configured to press a substrate against the polishing pad, the top ring having a pressure chamber for pressing the substrate against the polishing pad; and a pressure regulator coupled to the top ring and configured to regulate pressure in the pressure chamber, the pressure regulator including: a pressure-regulating valve configured to regulate pressure of a fluid supplied from a fluid supply source; a first pressure sensor configured to measure the pressure regulated by the pressure-regulating valve; a second pressure sensor located downstream of the first pressure sensor; a PID controller configured to produce a correction pressure command value for eliminating a difference between a pressure command value and a pressure value of the fluid measured by the second pressure sensor; and a regulator controller configured to control operation of the pressure-regulating valve so as to eliminate a difference between the correction pressure command value and a pressure value of the fluid measured by the first pressure sensor.

Still another aspect of the present invention provides a polishing method, comprising: supplying a fluid from a fluid supply source into a pressure chamber of a top ring via a pressure-regulating valve; measuring pressure of the fluid existing downstream of the pressure-regulating valve by a first pressure sensor; measuring pressure of the fluid by a second pressure sensor located downstream of the first pressure sensor; producing a correction pressure command value for eliminating a difference between a pressure command value and a pressure value of the fluid measured by the second pressure sensor; regulating pressure in the pressure chamber by controlling operation of the pressure-regulating valve so as to eliminate a difference between the correction pressure command value and a pressure value of the fluid measured by the first pressure sensor; and pressing a substrate against a polishing pad with the pressure chamber having the regulated pressure therein to polish the substrate.

According to the present invention, a first loop control is constructed by the first pressure sensor and the regulator controller, and a second loop control is constructed by the second pressure sensor and the PID controller. Such a double loop control structure can eliminate the temperature drift that has occurred in the first pressure sensor and other effects. Therefore, the pressure regulator can regulate the fluid pressure based on an actual pressure value or a pressure value close to the actual pressure.

DETAILED DESCRIPTION OF THE PREFERRED EMBODIMENTS

Embodiments of the present invention will be described below with reference to the drawings.

Figure 3:
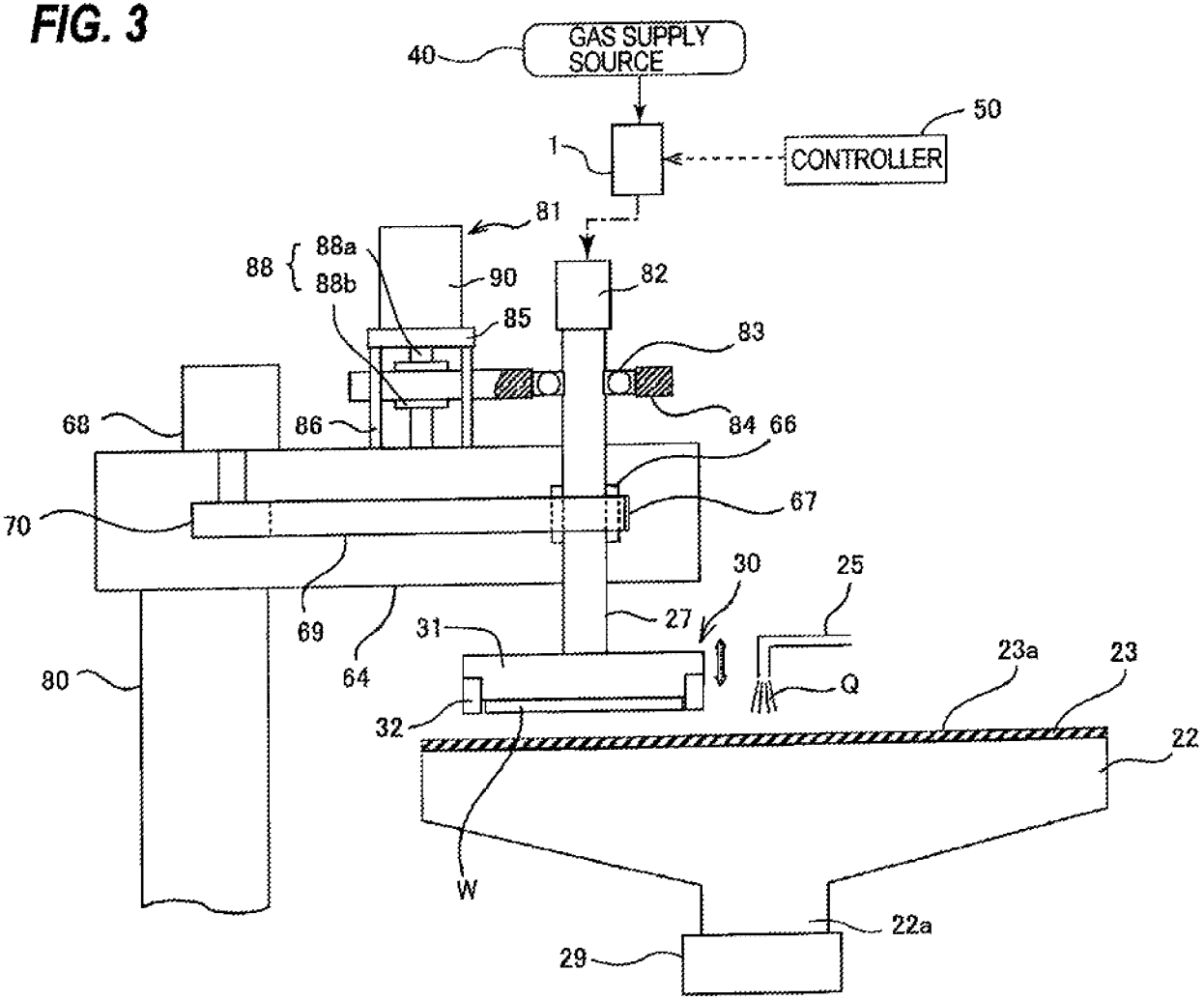
FIG. 3 is a schematic view of a polishing apparatus including a pressure regulator according to an embodiment of the present invention.

FIG. 3 is a schematic view showing a polishing apparatus including a pressure regulator according to an embodiment. As shown in FIG. 3, the polishing apparatus includes a polishing table 22 supporting a polishing pad 23, and a top ring (or a substrate holder) 30 for holding a substrate, such as a wafer, as an object to be polished and pressing the substrate against the polishing pad 23 on the polishing table 22.

The polishing table 22 is coupled via a table shaft 22*a* to a table motor 29 which is disposed below the polishing table 22, and the polishing table 22 is rotatable about the table shaft 22*a*. The polishing pad 23 is attached to an upper surface of the polishing table 22. The polishing pad 23 has a surface 23*a* that serves as a polishing surface for polishing a wafer W. A polishing liquid supply unit 25 is provided above the polishing table 22 to supply a polishing liquid Q onto the polishing pad 23 on the polishing table 22.

The top ring 30 includes a top ring body 31 for pressing the wafer W against the polishing surface 23*a*, and a retaining ring 32 for retaining the wafer W therein so as to prevent the wafer W from coming off the top ring 30. The top ring 30 is connected to a top ring shaft 27, which is vertically movable relative to a top ring head 64 by a vertically moving mechanism 81. This vertical movement of the top ring shaft 27 causes the top ring 30 in its entirety to move upward and downward relative to the top ring head 64 and enables positioning of the top ring 30. A rotary joint 82 is mounted to the upper end of the top ring shaft 27.

The vertically moving mechanism 81 for vertically moving the top ring shaft 27 and the top ring 30 includes a bridge 84 for rotatably supporting the top ring shaft 27 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the top ring head 64 through the support posts 86.

The ball screw 88 includes a screw shaft 88*a* coupled to the servomotor 90 and a nut 88*b* that engages with the screw shaft 88*a*. The top ring shaft 27 is vertically movable in unison with the bridge 84. When the servomotor 90 is set in motion, the bridge 84 moves vertically through the ball screw 88, so that the top ring shaft 27 and the top ring 30 move vertically.

The top ring shaft 27 is connected to a rotary sleeve 66 by a key (not shown). A timing pulley 67 is secured to a circumferential surface of the rotary sleeve 66. A top ring motor 68 is fixed to the top ring head 64. The timing pulley 67 is operatively coupled to a timing pulley 70, which is mounted to the top ring motor 68, through a timing belt 69. When the top ring motor 68 is set in motion, the rotary sleeve 66 and the top ring shaft 27 are rotated in unison through the timing pulley 70, the timing belt 69, and the timing pulley 67, thus rotating the top ring 30. The top ring head 64 is supported by a top ring head shaft 80, which is rotatably supported by a frame (not shown). The polishing apparatus further includes a polishing controller 50 for controlling devices including the top ring motor 68 and the servomotor 90.

The top ring 30 is configured to hold the wafer W on its lower surface. The top ring head 64 is configured to be able to pivot on the top ring head shaft 80. Thus, the top ring 30, which holds the wafer W on its lower surface, is moved between a position at which the top ring 30 receives the wafer W and a position above the polishing table 22 by a pivotal movement of the top ring head 64. Polishing of the wafer W is performed as follows. The top ring 30 and the polishing table 22 are rotated individually, while the polishing liquid Q is supplied onto the polishing pad 23 from the polishing liquid supply unit 25 provided above the polishing table 22. In this state, the top ring 30 is lowered and then presses the wafer W against the polishing surface 23*a* of the polishing pad 23. The wafer W is placed in sliding contact with the polishing surface 23*a* of the polishing pad 23, so that a surface of the wafer W is polished.

Figure 4:
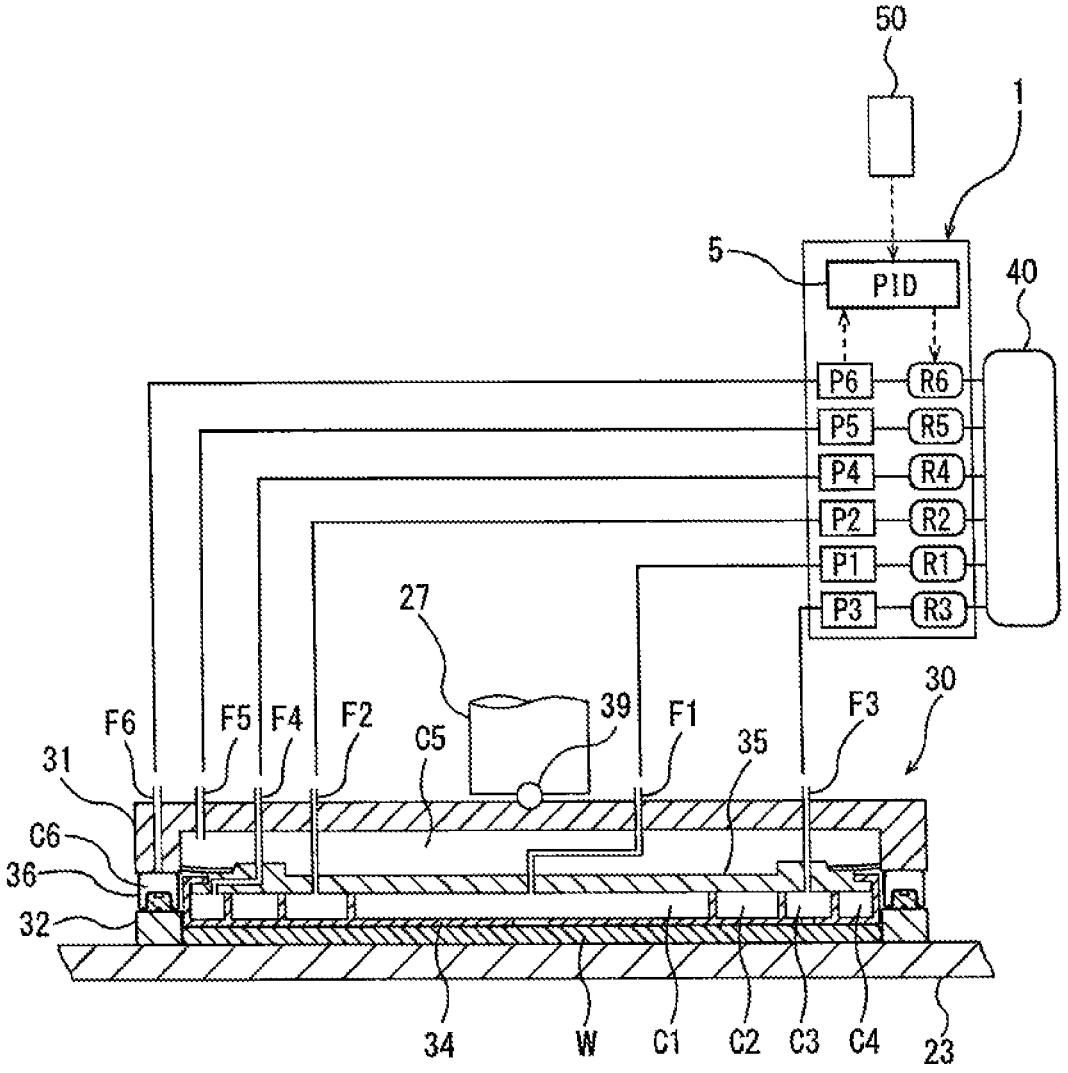
FIG. 4 is a cross-sectional view showing a top ring of the polishing apparatus.

Next, the top ring 30 will be described. FIG. 4 is a cross-sectional view of the top ring 30. The top ring 30 has the top ring body 31 coupled to the top ring shaft 27 via a universal joint 39, and the retaining ring 32 provided below the top ring body 31.

The top ring 30 further has a flexible membrane (elastic membrane) 34 to be brought into contact with the wafer W, and a chucking plate 35 that holds the membrane 34. The membrane 34 and the chucking plate 35 are disposed below the top ring body 31. Four pressure chambers (or air bags) C1, C2, C3, and C4 are provided between the membrane 34 and the chucking plate 35. The pressure chambers C1, C2, C3, and C4 are formed by the membrane 34 and the chucking plate 35. The central pressure chamber C1 has a circular shape, and the other pressure chambers C2, C3, and C4 have an annular shape. These pressure chambers C1, C2, C3, and C4 are in a concentric arrangement.

Pressurized gas (pressurized fluid), such as pressurized air, is supplied into the pressure chambers C1, C2, C3, and C4 by a gas supply source (i.e., a fluid supply source) 40 through fluid passages F1, F2, F3, and F4, respectively. Further, a non-illustrated vacuum source is coupled to the pressure chambers C1, C2, C3, and C4 so that negative pressure is produced in these pressure chambers. The pressures in the pressure chambers C1, C2, C3, and C4 can be changed independently to thereby independently adjust loads on four zones of the wafer W: a central portion; an inner intermediate portion; an outer intermediate portion; and a peripheral portion. Further, by elevating or lowering the top ring 30 in its entirety, the retaining ring 32 can press the polishing pad 23 at a predetermined pressure.

A pressure chamber C5 is formed between the chucking plate 35 and the top ring body 31. Pressurized gas is supplied into the pressure chamber C5 by the gas supply source 40 through a fluid passage F5. Further, the non-illustrated vacuum source is coupled to the pressure chamber C5 so that negative pressure is produced in this pressure chamber. With these operations, the chucking plate 35 and the membrane 34 in their entirety can move up and down. The retaining ring 32 is arranged around the periphery of the wafer W so as to prevent the wafer W from corning off the top ring 30 during polishing. The membrane 34 has an opening in a portion that forms the pressure chamber C3, so that the wafer W can be held by the top ring 30 via the vacuum suction by producing vacuum in the pressure chamber C3. Further, the wafer W can be released from the top ring 30 by supplying nitrogen gas or clean air into the pressure chamber C3.

An annular rolling diaphragm 36 is provided between the top ring body 31 and the retaining ring 32. A pressure chamber C6 is formed in this rolling diaphragm 36, and is coupled to the gas supply source 40 through a fluid passage F6. The gas supply source 40 supplies the pressurized gas into the pressure chamber C6, so that the rolling diaphragm 36 presses the retaining ring 32 against the polishing pad 23.

The fluid passages F1, F2, F3, F4, F5, and F6, communicating with the pressure chambers C1, C2, C3, C4, C5, and C6, are provided with electropneumatic regulators R1, R2, R3, R4, R5, and R6, respectively. The pressurized gas from the gas supply source 40 is supplied into the pressure chambers C1 to C6 through the electropneumatic regulators R1 to R6. These electropneumatic regulators R1 to R6 are configured to regulate the pressure in the pressure chambers C1 to C6 by regulating the pressure of the pressurized gas supplied from the gas supply source 40. The electropneumatic regulators R1 to R6 are coupled to a PID controller 5, which is coupled to the polishing controller 50. The PID controller 5 may be incorporated in the polishing controller 50. The pressure chambers C1 to C6 are further coupled to vent valves (not shown), respectively, so that the pressure chambers C1 to C6 can be ventilated to the atmosphere.

Inline pressure sensors P1, P2, P3, P4, P5, and P6 are provided between the electropneumatic regulators R1, R2, R3, R4, R5, and R6 and a point of use of the pressurized gas. These inline pressure sensors P1 to P6 are provided respectively in the fluid passages F1 to F6 that communicate with the pressure chambers C1 to C6, so that the pressures in the fluid passages F1 to F6 and in the pressure chambers C1 to C6 are measured by the inline pressure sensors P1 to P6.

Figure 5:
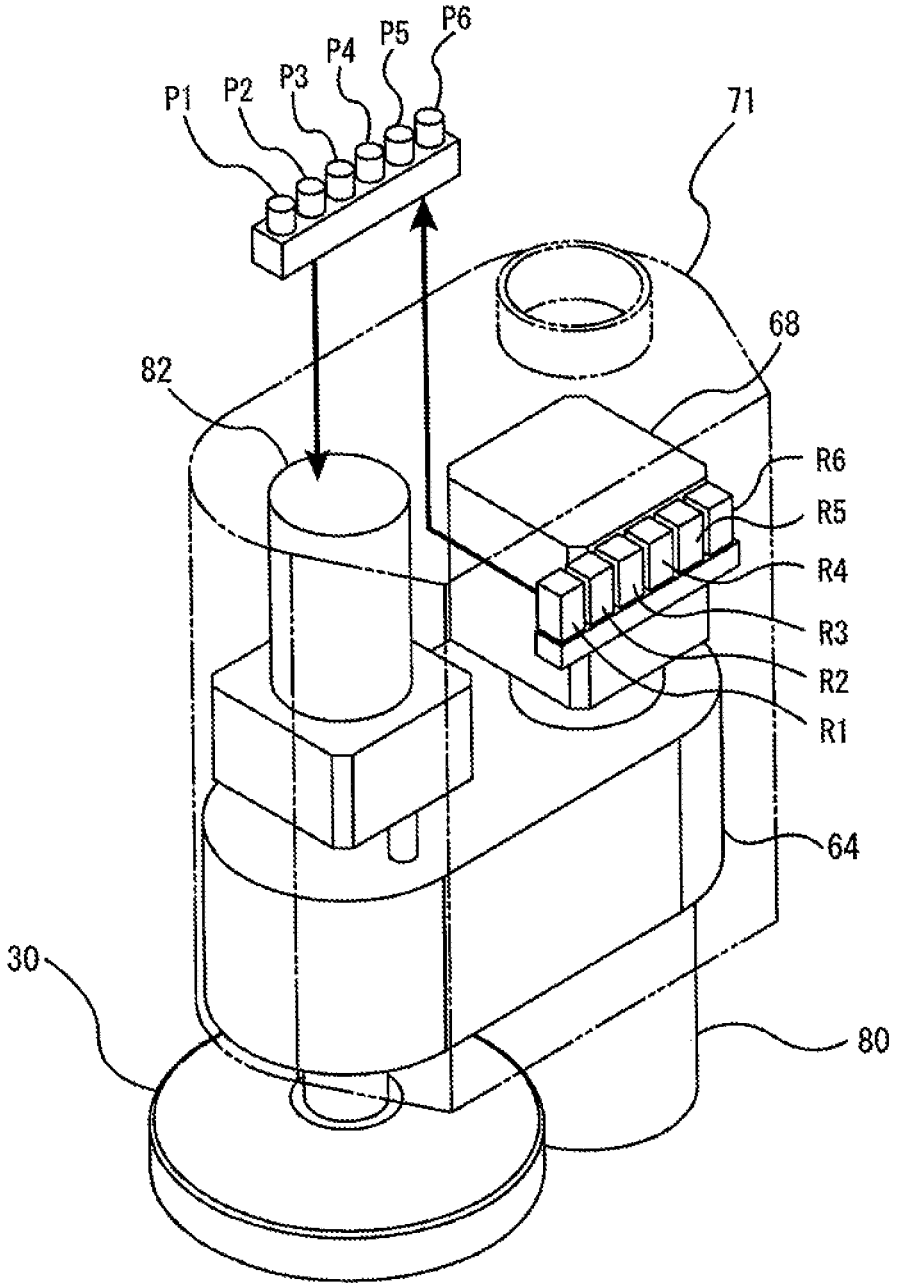
FIG. 5 is a perspective view showing a part of the polishing apparatus.

FIG. 5 is a perspective view showing arrangement of the electropneumatic regulators R1 to R6 and the inline pressure sensors P1 to P6. As shown in FIG. 5, the electropneumatic regulators R1 to R6 are mounted to the top ring motor 68, while the inline pressure sensors P1 to P6 are located away from the electropneumatic regulators R1 to R6 and the top ring head 64. This is for the purpose of preventing the temperature drift of the inline pressure sensors P1 to P6 caused by heat emitted from heat sources including the top ring motor 68 and the rotary joint 82. In order to keep away from these heat sources, the inline pressure sensors P1 to P6 are arranged away from the top ring head 64. More specifically, the inline pressure sensors P1 to P6 are disposed outside a top ring head cover 71 and inside the polishing apparatus.

The inline pressure sensors P1 to P6 are preferably installed in an atmosphere with a constant temperature. For example, the inline pressure sensors P1 to P6 may be installed in an open space in the polishing apparatus, e.g., a space outside the top ring cover 71. Generally, a clean room in which the polishing apparatus is installed has a temperature control device that keeps the temperature in the clean room constant. Therefore, in order to keep the temperature of the atmosphere surrounding the inline pressure sensors P1 to P6 constant, these inline pressure sensors P1 to P6 are preferably arranged in the above-mentioned open space which has a temperature close to the temperature in the clean room. For example, the inline pressure sensors P1 to P6 may be provided on a ceiling of the polishing apparatus. Further, the inline pressure sensors P1 to P6 may be located outside the polishing apparatus. For example, the inline pressure sensors P1 to P6 may be provided on an outer surface of the polishing apparatus or in a place away from the polishing apparatus. Measuring points of the respective inline pressure sensors P1 to P6 are preferably located as close to the top ring 30, which is the point of use of the pressurized gas, as possible.

The polishing controller 50 is configured to produce pressure command values which are target pressure values for the pressure chambers C1 to C6. The pressure command values for the pressure chambers C1, C2, C3, and C4 are produced based on film-thickness measurement values obtained at wafer surface zones corresponding to the pressure chambers C1, C2, C3, and C4. The polishing controller 50 sends the pressure command values to the PID controller 5, which produces correction pressure command values for eliminating differences between the pressure current values measured by the inline pressure sensors P1 to P6 and the corresponding pressure command values. The PID controller 5 sends the correction pressure command values to the electropneumatic regulators R1 to R6, which then operate such that the pressures in the pressure chambers C1 to C6 are maintained at the corresponding correction pressure command values. In this manner, the top ring 30 having multiple pressure chambers can press the multiple zones of the wafer surface independently against the polishing pad 23 according to the progress of the wafer polishing and can therefore polish a film of the wafer W uniformly.

The electropneumatic regulators R1 to R6, the inline pressure sensors P1 to P6, and the PID controller 5 constitute a pressure regulator 1 for regulating the pressures in the pressure chambers C1 to C6 of the top ring 30. The electropneumatic regulators R1 to R6 have the same structure and are arranged in parallel. Similarly, the inline pressure sensors P1 to P6 have the same structure and are arranged in parallel. The inline pressure sensors P1 to P6 are coupled respectively to the electropneumatic regulators R1 to R6 in series. Multiple polishing controllers 5 may be provided for multiple electropneumatic regulators and multiple inline pressure sensors. The pressure regulator 1 according to one embodiment includes the multiple electropneumatic regulators R1 to R6 and the multiple inline pressure sensors P1 to P6. The pressure regulator 1 according to another embodiment may include one electropneumatic regulator and one inline pressure sensor.

Figure 6:
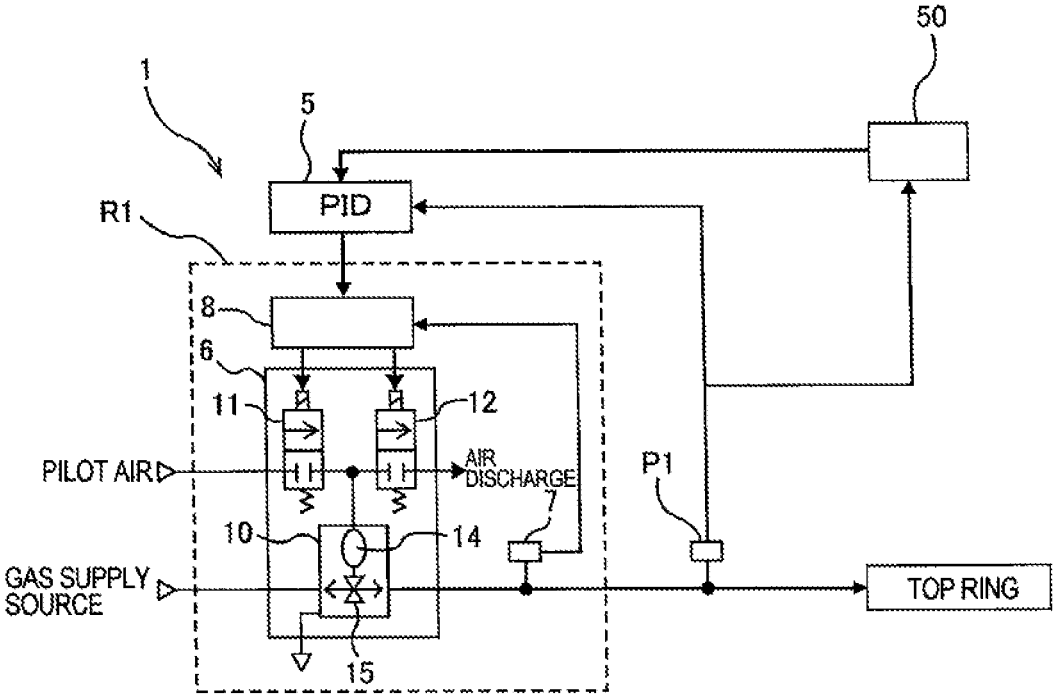
FIG. 6 is a schematic view of the pressure regulator according to the embodiment of the present invention.

Next, for the purpose of making the explanation easy, an embodiment of the pressure regulator 1 having one electropneumatic regulator R1 and one inline pressure sensor P1 will be described with reference to FIG. 6. As shown in FIG. 6, the pressure regulator 1 has the electropneumatic regulator R1, the inline pressure sensor P1 located downstream (i.e., at the secondary side) of the electropneumatic regulator R1, and the PID controller 5 coupled to the inline pressure sensor P1.

The electropneumatic regulator R1 has a pressure-regulating valve 6 for regulating the pressure of the gas supplied from the gas supply source 40, an internal pressure sensor (a first pressure sensor) 7 for measuring the pressure (i.e., the secondary pressure) of the gas downstream of the pressure-regulating valve 6, and a regulator controller 8 for controlling operation of the pressure-regulating valve 6 based on pressure value obtained by the internal pressure sensor 7.

The pressure-regulating valve 6 has a pilot valve 10 for regulating the pressure of the gas supplied from the gas supply source 40, and a gas-intake electromagnetic valve 11 and a gas-release electromagnetic valve 12 each for regulating pressure of a pilot air to be supplied to the pilot valve 10. The pilot valve 10 has a pilot chamber 14 and a valve element 15 coupled to the pilot chamber 14. A part of the pilot chamber 14 is formed from a diaphragm. The pilot air is supplied into the pilot chamber 14 through the gas-intake electromagnetic valve 11 and is discharged from the pilot chamber 14 through the gas-release electromagnetic valve 12. Therefore, the pressure in the pilot chamber 14 is controlled by operating the gas-intake electromagnetic valve 11 and the gas-release electromagnetic valve 12. The regulator controller 8 controls open-close operations of the electromagnetic valves 11, 12, and the valve element 15 is moved according to the pressure in the pilot chamber 14. Depending on the position of the valve element 15, the gas from the gas supply source 40 passes through the pilot valve 10, or the gas downstream of the pilot valve 10 (i.e., the gas on the secondary side) is discharged through the pilot valve 10, so that the pressure of the gas downstream of the pilot valve 10 (i.e., the secondary pressure) is regulated. This type of electropneumatic regulator R1 is configured to regulate the pressure by controlling a duty ratio of the gas-intake electromagnetic valve 11 to the gas-release electromagnetic valve 12. The present invention is not limited to this type, and can be applied to other type of electropneumatic regulator, such as a proportional control valve type and a force balance type.

The pressure-regulating valve 6, the regulator controller 8, and the internal pressure sensor (the first pressure sensor) 7 are assembled integrally to constitute the electropneumatic regulator R1, while the inline pressure sensor (i.e., the second pressure sensor) P1 is separated from the electropneumatic regulator R1. This inline pressure sensor P1 is located downstream of the internal pressure sensor 7, and disposed between the electropneumatic regulator R1 and the top ring 30. A pressure measuring point of the inline pressure sensor P1 is preferably near the top ring 30 which is the point of use. The inline pressure sensor P1 measures the pressure of the gas that exists downstream of the electropneumatic regulator R1, i.e., the current pressure in the fluid passage F1 and the pressure chamber C1 and sends the pressure current value to the PID controller 5.

The inline pressure sensor P1 has a higher measuring accuracy than a measuring accuracy of the internal pressure sensor 7. More specifically, the inline pressure sensor P1 is superior to the internal pressure sensor 7 with respect to all of evaluation items, such as linearity, hysteresis, stability, and repeatability which are generally used as indexes indicating the pressure measuring accuracy of a pressure sensor.

As shown in FIG. 6, the inline pressure sensor P1 is further coupled to the polishing controller 50, so that the pressure current value obtained by the inline pressure sensor P1 is sent to the polishing controller 50. The polishing controller 50 uses this pressure current value as a value indicating the current pressure in the pressure chamber P1 of the top ring and produces the above-described pressure command value based on the pressure current value.

The PID controller 5 is coupled to the polishing controller 50 of the polishing apparatus. The pressure command value, which is produced by the polishing controller 50, is sent to the PID controller 5. The PID controller 5 produces the correction pressure command value (analog signal) for eliminating the difference between the pressure current value and the pressure command value and sends the correction pressure command value to the regulator controller 8. This regulator controller 8 controls the operations of the gas-intake electromagnetic valve 11 and the gas-release electromagnetic valve 12 so as to eliminate the difference between the correction pressure command value and the pressure value sent from the internal pressure sensor 7.

The pilot air in the pilot chamber 14 actuates the valve element 15 of the pilot valve 10, so that the pressure of the gas (e.g., air or nitrogen gas) is regulated. The pressure of the gas downstream of the pilot valve 10 is measured by the internal pressure sensor 7, and is further measured by the inline pressure sensor P1 located downstream of the internal pressure sensor 7. The pressure current value, obtained by the internal pressure sensor 7, is fed back to the regulator controller 8, while the pressure current value, obtained by the inline pressure sensor P1, is fed back to the PID controller 5. That is, the pressure regulator 1 has a double loop control structure.

Figure 7:
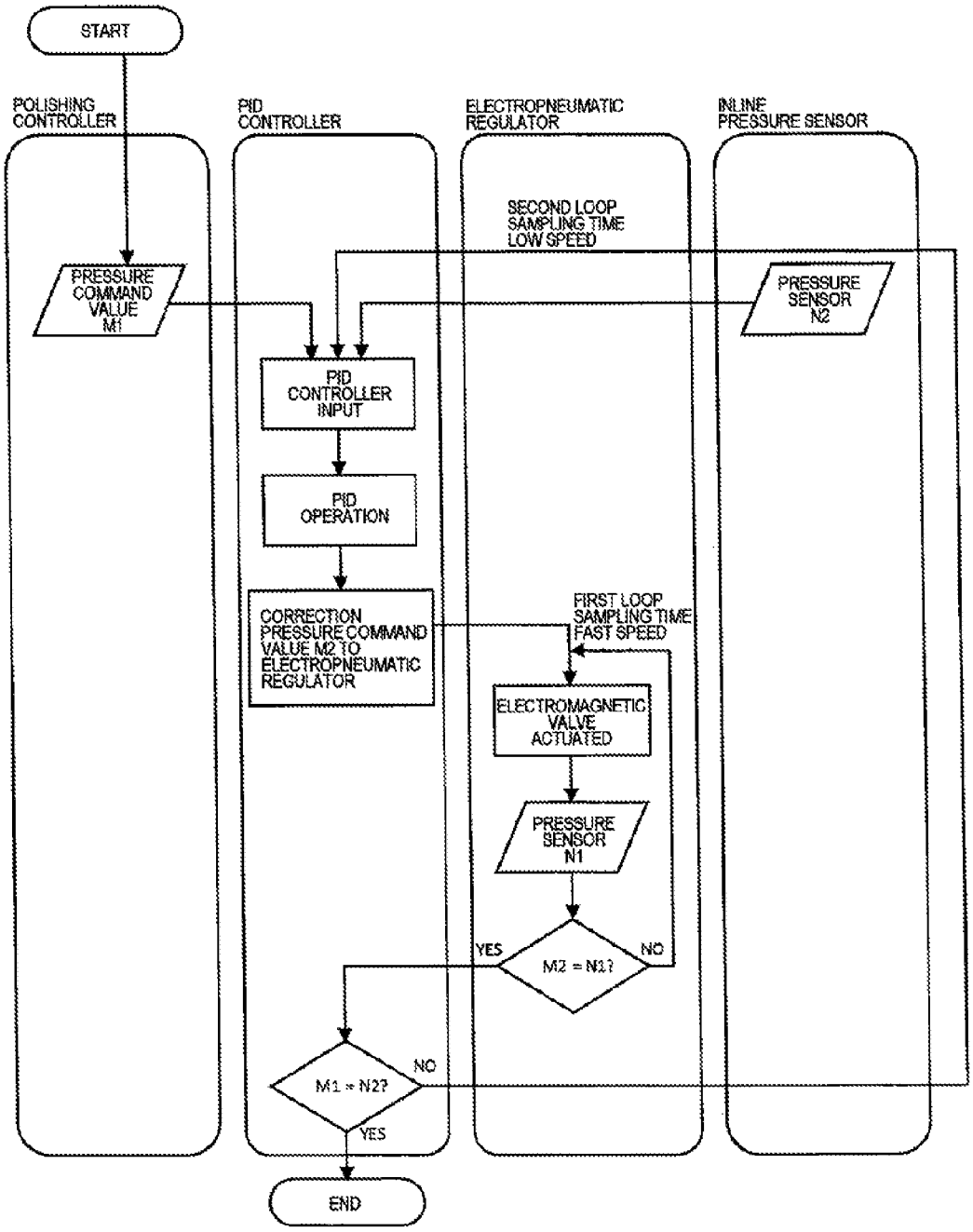
FIG. 7 is a diagram showing a control flow of the pressure regulator.

FIG. 7 is a diagram showing a control flow of the pressure regulator 1. The polishing controller 50 of the polishing apparatus produces a pressure command value M1, which is sent to the PID controller 5. A pressure current value N2, which is obtained by the inline pressure sensor P1, is also sent to the PID controller 5. The PID controller 5 performs PID operation to produce a correction pressure command value M2 for eliminating the difference between the pressure command value M1 and the pressure current value N2. This correction pressure command value M2 is sent to the regulator controller 8 of the electropneumatic regulator R1.

The regulator controller 8 compares the correction pressure command value M2 with a pressure current value N1 which is obtained by the internal pressure sensor 7, and repeats the operations of the electromagnetic valves 11, 12 and obtaining of the pressure current value N1 until the pressure current value N1 becomes equal to the correction pressure command value M2 (a first loop control). If the pressure current value N1 is equal to the correction pressure command value M2, then the PID controller 5 compares the pressure command value M1 and the pressure current value N2. If the pressure current value N2 is not equal to the pressure command value M1, then the PID controller 5 takes in the pressure command value M1 and the pressure current value N2 again, and produces the correction pressure command value M2 again for eliminating the difference between the pressure command value M1 and the pressure current value N2. Producing the correction pressure command value M2, performing the first loop control, and obtaining the pressure current value N2 are repeated until the pressure current value N2 becomes equal to the pressure command value M1 (a second loop control). A sampling time of the pressure current value N1 in the first loop control is preferably shorter than a sampling time of the pressure current value N2 in the second loop control.

Figure 8A:
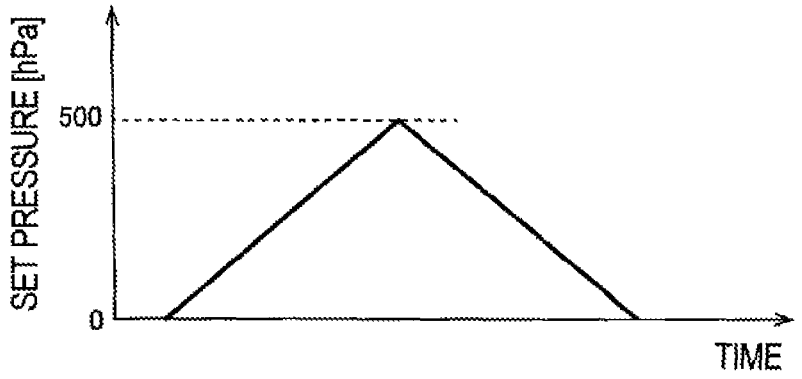
FIG. 8A and FIG. 8B are diagrams illustrating a linearity evaluation and a hysteresis evaluation.
Figure 8B:
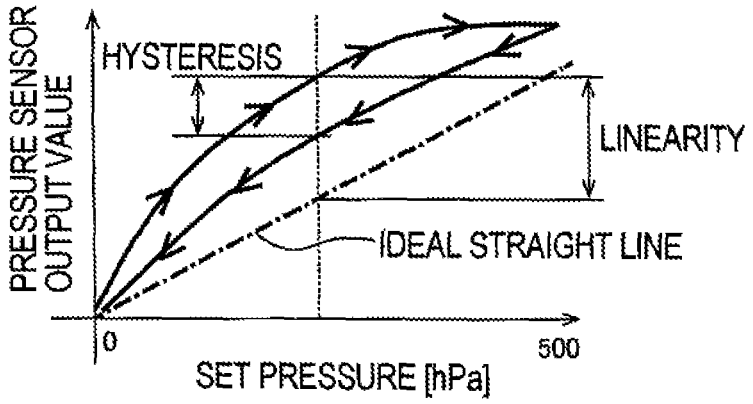

Next, the evaluation results of the pressure regulating apparatus 1 having the above-discussed structures will be described. The evaluation of the pressure regulating apparatus 1 was conducted on four items: the linearity; the hysteresis; the stability; and the repeatability. FIG. 8A and FIG. 8B are diagrams illustrating the linearity evaluation and the hysteresis evaluation. The linearity evaluation was conducted as follows. As shown in FIG. 8A, pressure of a gas was increased linearly from 0 to 500 hPa and was then decreased linearly to 0 hPa, while the pressure of the gas was measured by the inline pressure sensor P1.

FIG. 8B shows a graph indicating sensor output value i.e., the value of the pressure measured by the inline pressure sensor P1 when the pressure of the gas was increased linearly from 0 hPa to 500 hPa and then decreased linearly from 500 hPa to 0 hPa. An ideal straight line shown in FIG. 8B is an ideal line plotted by output values of an ideal pressure sensor when the pressure of the gas is changed linearly. The linearity is represented by a maximum value of a difference between an ideal value on the ideal straight line and a corresponding output value of the inline pressure sensor P1. The hysteresis is represented by a maximum value of a difference between a sensor output value when the pressure is increasing and a sensor output value when the pressure is decreasing.

Figure 9A:
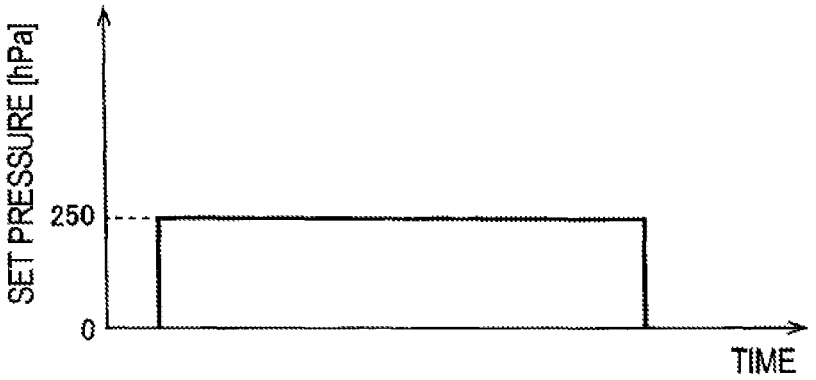
FIG. 9A and FIG. 9B are diagrams illustrating a stability evaluation.
Figure 9B:
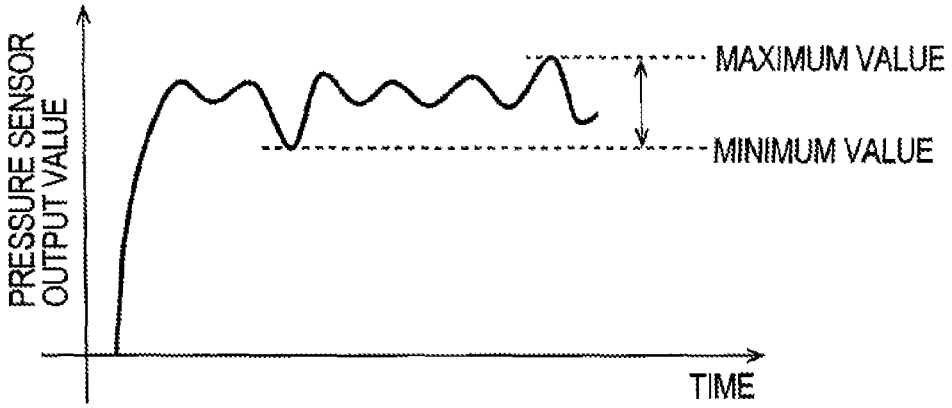

FIG. 9A and FIG. 9B are diagrams illustrating the stability evaluation. The stability evaluation was conducted as follows. As shown in FIG. 9A, the pressure of the gas was maintained at 250 hPa for two hours, while the pressure of the gas was measured by the inline pressure sensor P1.

FIG. 9B shows a graph indicating output value of the inline pressure sensor P1 when measured the pressure of the gas for two hours while the pressure has been maintained at 250 hPa. As shown in FIG. 9B, while the pressure of the gas was kept constant, the output value of the inline pressure sensor P1 fluctuated slightly. The stability is represented by a difference between a maximum value and a minimum value of the output value of the inline pressure sensor P1 when measuring the pressure of the gas for a predetermined period of time while the gas is kept at a constant pressure.

Figure 10A:
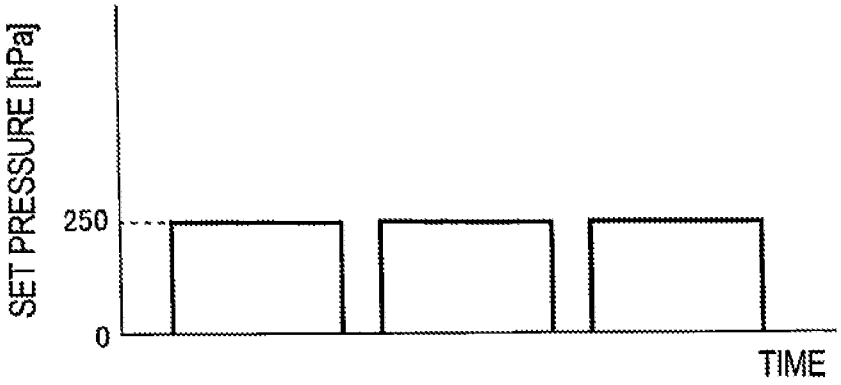
FIG. 10A and FIG. 10B are diagrams illustrating a repeatability evaluation.
Figure 10B:
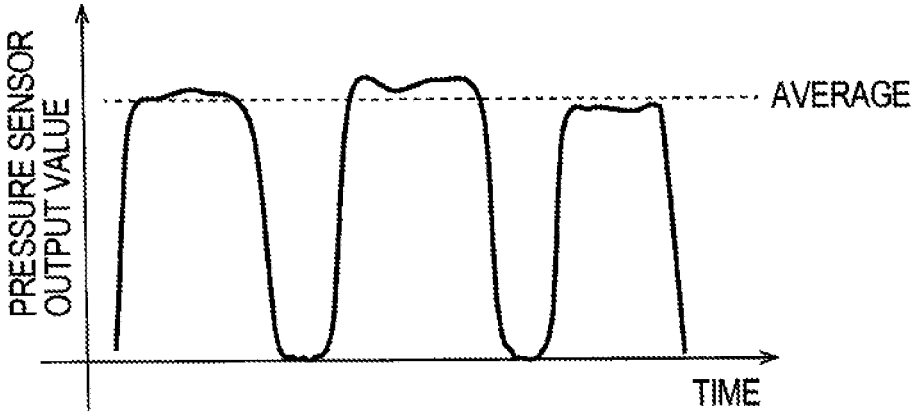

FIG. 10A and FIG. 10B are diagrams illustrating the repeatability evaluation. The repeatability evaluation was conducted as follows. As shown in FIG. 10A, the pressure of the gas was shifted between 0 hPa and 250 hPa at predetermined time intervals, while the pressure of the gas was measured by the inline pressure sensor P1.

FIG. 10B shows a graph indicating the sensor output value i.e., the value of the pressure measured by the inline pressure sensor P1 when the pressure of the gas was shifted between 0 hPa and 250 hPa periodically. As shown in FIG. 10B, the repeatability is represented by an average of the sensor output value obtained when the pressure is at a predetermined value while the pressure is shifted between 0 hPa and the predetermined value repeatedly.

Figure 11A:
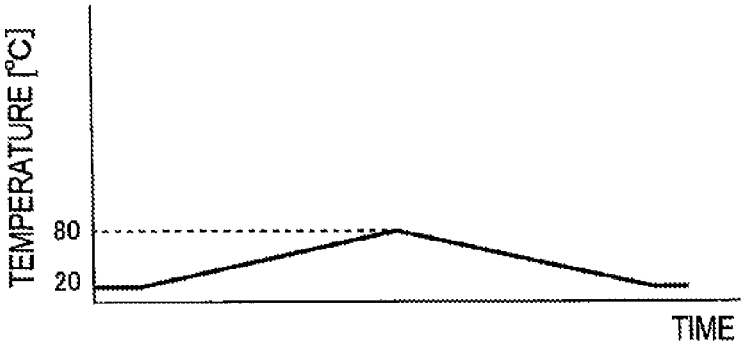
FIG. 11A and FIG. 11B are diagrams illustrating a temperature characteristic evaluation.
Figure 11B:
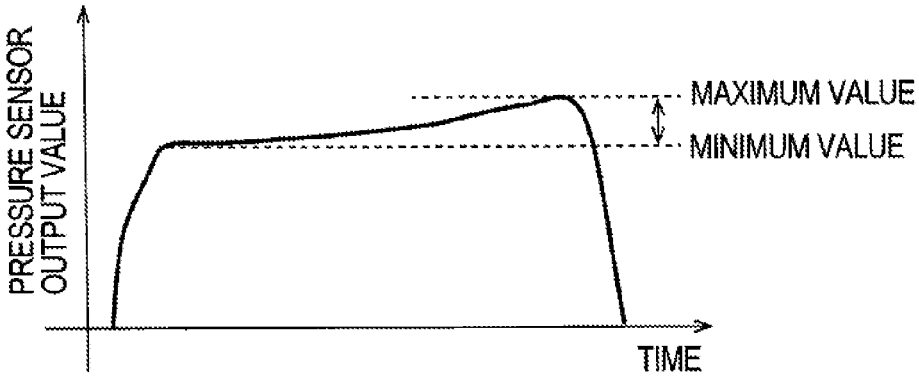

The evaluation items may include a temperature characteristic evaluation which will be described below. FIG. 11A and FIG. 11B are diagrams illustrating the temperature characteristic evaluation. The temperature characteristic evaluation is conducted as follows. As shown in FIG. 11A, the temperature of the gas with a constant pressure of 250 hPa is increased from 25 degrees to 80 degrees and is then decreased to 25 degrees, while the pressure of the gas is measured by the inline pressure sensor P1.

FIG. 11B shows a graph indicating the sensor output value i.e., the value of the pressure measured by the inline pressure sensor P1 when the temperature of the gas was increased from 25 degrees to 80 degrees and was then decreased to 25 degrees. As shown in FIG. 11B, while the pressure of the gas was kept constant, the sensor output value fluctuated slightly due to the temperature. The temperature characteristic is represented by a difference between a maximum value and a minimum value of the sensor output value when the temperature of the gas with a constant pressure is changed.

Figure 1:
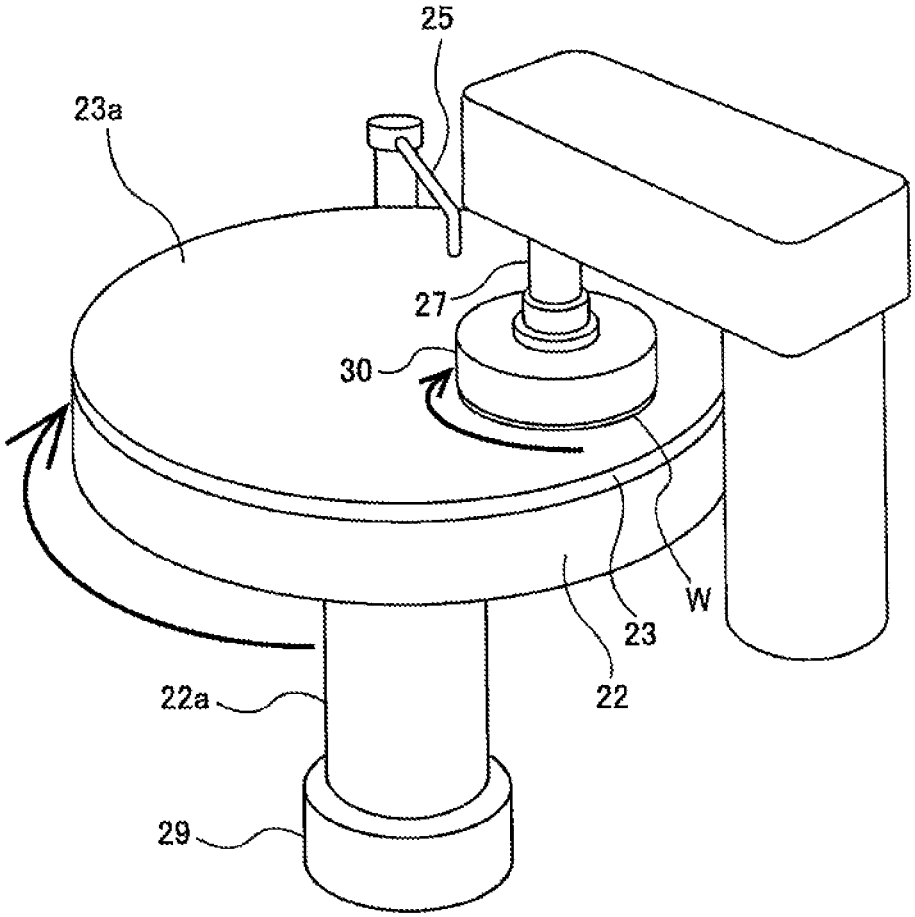
FIG. 1 is a schematic view of a polishing apparatus for polishing a wafer.
Figure 2:
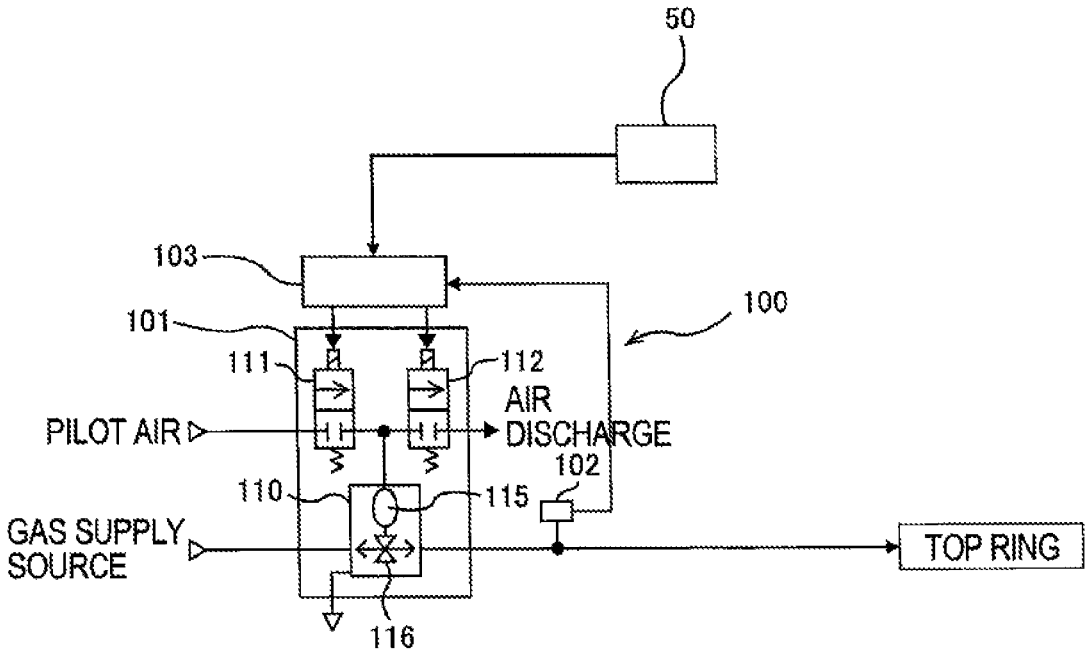
FIG. 2 is a schematic view showing a conventional pressure regulator.
Figure 12:
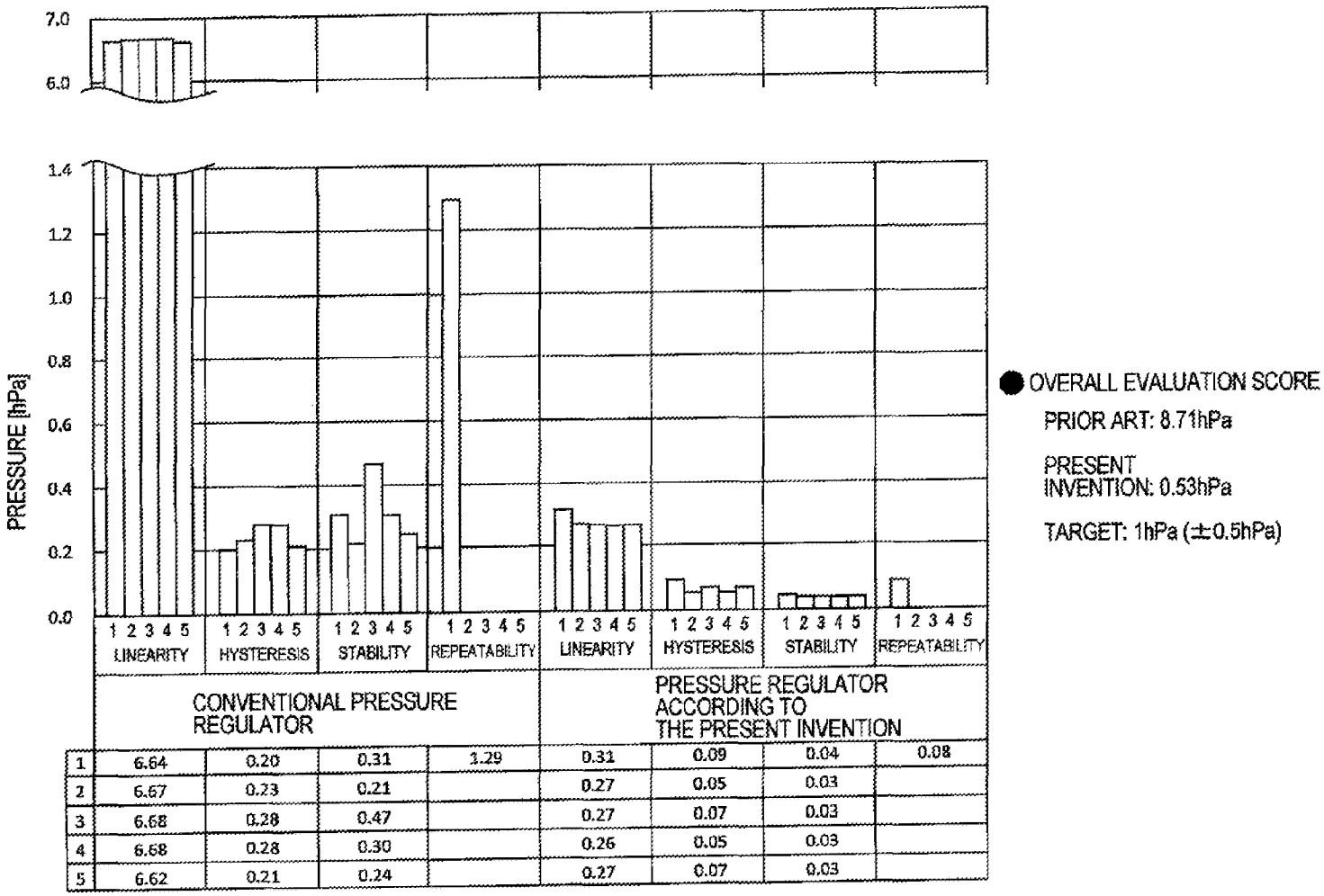
FIG. 12 is a diagram showing evaluation results of the conventional pressure regulator shown in FIG. 2 and evaluation results of the pressure regulator shown in FIG. 6.

FIG. 12 is a diagram showing evaluation results of the conventional pressure regulator shown in FIG. 2 and evaluation results of the pressure regulator shown in FIG. 6. Overall evaluation score in FIG. 12 represents the sum total of the worst values (i.e., the largest values) of scores in the respective evaluation items: the linearity; the hysteresis; the stability; and the repeatability. The smaller score indicates higher measuring accuracy. As can be seen from FIG. 12, in all of the evaluation items, the pressure regulator according to the embodiment is superior to the conventional pressure regulator. Therefore, the pressure regulator according to the present invention can accurately control the pressure in the pressure chamber of the top ring.

Although the inline pressure sensor P1 is a highly-accurate pressure sensor as discussed above, the output value of the inline pressure sensor P1 may deviate from a correct value due to some causes. In such a case, the inline pressure sensor P1 is calibrated. The calibration of the inline pressure sensor P1 is conducted with use of a more highly-accurate pressure sensor (which will be referred to as ultra-accurate pressure sensor) than the inline pressure sensor P1. This ultra-accurate pressure sensor is coupled to the inline pressure sensor P1. In this state, the pressure of the gas is changed linearly. The pressure of the gas is measured by the ultra-accurate pressure sensor and the inline pressure sensor P1 simultaneously, and output values of these pressure sensors are transmitted to the PID controller 5.

The PID controller 5 compares output values of the ultra-accurate pressure sensor and output values of the inline pressure sensor P1 at predetermined multiple pressure values, and determines differences between the output values at each of the multiple pressure values. Further, the PID controller 5 creates a conversion formula for eliminating the differences between the output values at each of the multiple pressure values. This conversion formula is a formula for converting the output value of the inline pressure sensor P1 into a corresponding output value of the ultra-accurate pressure sensor. In other words, the conversion formula is a correction formula for correcting an error-containing output value of the inline pressure sensor P1.

Figure 13:
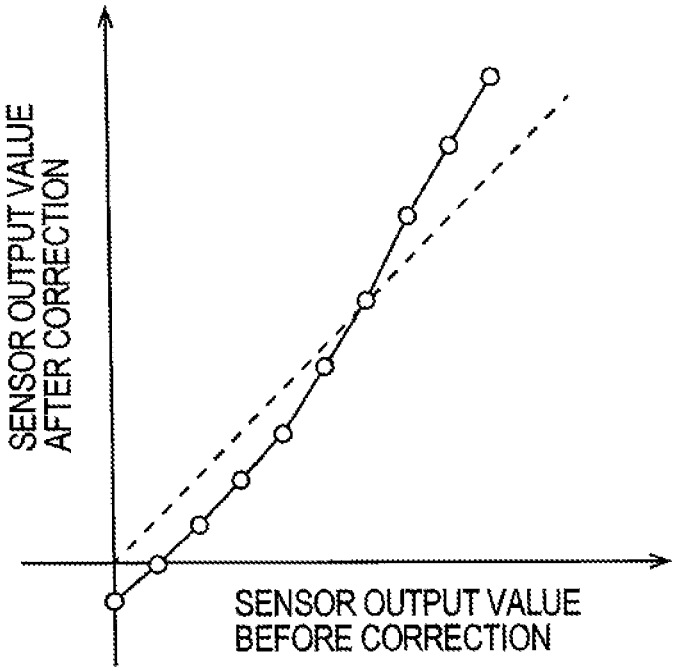
FIG. 13 is a diagram illustrating a correction formula for correcting an error-containing output value of an inline pressure sensor.

FIG. 13 is a diagram illustrating the conversion formula. In FIG. 13, horizontal axis represents the output value of the inline pressure sensor P1 (i.e., the sensor output value before the correction), and vertical axis represents the output value of the ultra-accurate pressure sensor (i.e., the sensor output value after the correction). The conversion formula for correcting the output value of the inline pressure sensor P1 is defined as a function of the output value of the inline pressure sensor P1 and is described as a curved graph or a line graph as shown in FIG. 13. By inputting the output value of the inline pressure sensor P1 into the conversion formula, the corrected sensor output value can be obtained.

Figure 14A:
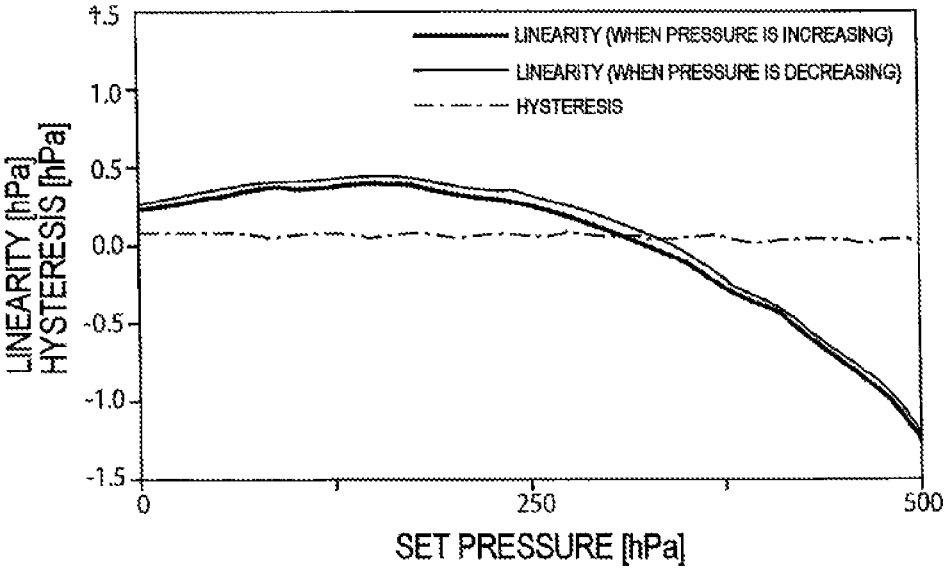
FIG. 14A is a diagram showing graphs representing the linearity and the hysteresis before the output value of the inline pressure sensor is corrected.
Figure 14B:
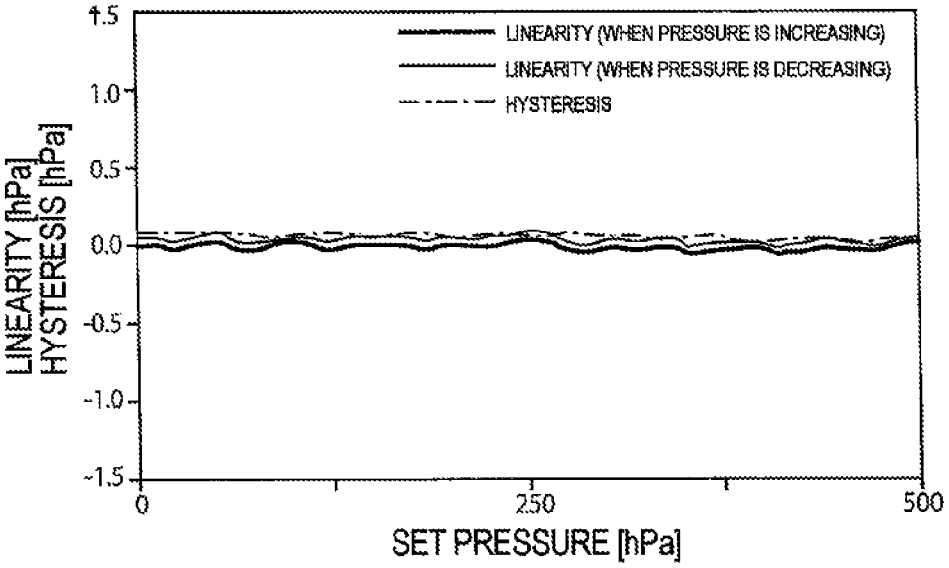
FIG. 14B is a diagram showing graphs representing the linearity and the hysteresis after the output value of the inline pressure sensor is corrected.

FIG. 14A is a diagram showing graphs representing the linearity and the hysteresis before the output value of the inline pressure sensor P is corrected, and FIG. 14B is a diagram showing graphs representing the linearity and the hysteresis after the output value of the inline pressure sensor P1 is corrected. As can be seen from the graphs shown in FIG. 14A and FIG. 14B, the linearity is improved by the use of the conversion formula. Therefore, more accurate pressure control can be performed based on the corrected sensor output value.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A pressure regulator, comprising:

a pressure-regulating valve configured to regulate pressure of a fluid supplied from a fluid supply source;

a first pressure sensor configured to measure the pressure regulated by the pressure-regulating valve;

a second pressure sensor located downstream of the first pressure sensor;

a PID controller configured to produce a correction pressure command value for eliminating a difference between a pressure command value and a pressure value of the fluid measured by the second pressure sensor; and a regulator controller configured to control operation of the pressure-regulating valve so as to eliminate a difference between the correction pressure command value and a pressure value of the fluid measured by the first pressure sensor.

2. The pressure regulator according to claim 1, wherein the first pressure sensor and the pressure-regulating valve are assembled integrally and the second pressure sensor is separated from the first pressure sensor and the pressure-regulating valve.

3. The pressure regulator according to claim 1, wherein the second, pressure sensor is located in an atmosphere with a constant temperature.

4. The pressure regulator according to claim 3, wherein the second pressure sensor is located in the atmosphere formed in a clean room with a constant temperature.

5. The pressure regulator according to claim 1, wherein the second pressure sensor has a higher pressure measuring accuracy than a pressure measuring accuracy of the first pressure sensor with respect to evaluation items including linearity, hysteresis, stability, and repeatability.

6. A polishing apparatus, comprising:

a polishing table for supporting a polishing pad;

a top ring configured to press a substrate against the polishing pad, the top ring having a pressure chamber for pressing the substrate against the polishing pad; and a pressure regulator coupled to the top ring and configured to regulate pressure in the pressure chamber, the pressure regulator including:

a pressure-regulating valve configured to regulate pressure of a fluid supplied from a fluid supply source;

a first pressure sensor configured to measure the pressure regulated by the pressure-regulating valve;

a second pressure sensor located downstream of the first pressure sensor;

a PID controller configured to produce a correction pressure command value for eliminating a difference between a pressure command value and a pressure value of the fluid measured by the second pressure sensor; and a regulator controller configured to control operation, of the pressure-regulating valve so as to eliminate a difference between the correction pressure command value and a pressure value of the fluid measured by the first pressure sensor.

7. The polishing apparatus according to claim 6, wherein the first pressure sensor and the pressure-regulating valve are assembled integrally and the second pressure sensor is separated from the first pressure sensor and the pressure-regulating valve.

8. The polishing apparatus according to claim 6, wherein the second pressure sensor is located in an atmosphere with a constant temperature.

9. The polishing apparatus according to claim 8, wherein the second pressure sensor is located in the atmosphere formed in a clean room with a constant temperature.

10. The polishing apparatus according to claim 6, wherein the second pressure sensor has a higher pressure measuring accuracy than a pressure measuring accuracy of the first pressure sensor with respect to evaluation items including linearity, hysteresis, stability, and repeatability.

11. A polishing method, comprising:

supplying a fluid from a fluid supply source into a pressure chamber of a top ring via a pressure-regulating valve;

measuring pressure of the fluid existing downstream of the pressure-regulating valve by a first pressure sensor;

measuring pressure of the fluid by a second pressure sensor located downstream of the first pressure sensor;

producing a correction pressure command value for eliminating a difference between a pressure command value and a pressure value of the fluid measured by the second pressure sensor;

regulating pressure in the pressure chamber by controlling operation of the pressure-regulating valve so as to eliminate a difference between the correction pressure command value and a pressure value of the fluid measured by the first pressure sensor; and pressing a substrate against a polishing pad with the pressure chamber having the regulated pressure therein to polish the substrate.

* * * * *